United States Patent [19]

Makabe et al.

[11] 4,419,947

[45] Dec. 13, 1983

[54] ELECTRONIC SEWING MACHINE

[75] Inventors: Hachiro Makabe, Kanagawa; Muneaki Hagiwara, Koganei; Haruhiko Tanaka, Mitaka, all of Japan

[73] Assignee: Janome Sewing Machine Co., Ltd., Tokyo, Japan

[21] Appl. No.: 294,171

[22] Filed: Aug. 19, 1981

[30] Foreign Application Priority Data

Aug. 29, 1980 [JP] Japan ..... 55-118282

[51] Int. Cl.[3] ..... D05B 3/02

[52] U.S. Cl. ..... 112/158 E

[58] Field of Search ..... 112/158 E, 121.11, 121.12, 112/102, 103

[56] References Cited

U.S. PATENT DOCUMENTS

| | | | |
|---|---|---|---|
| 4,116,144 | 9/1978 | Tanimoto et al. | 112/158 E |
| 4,138,955 | 2/1979 | Garron | 112/158 E |
| 4,142,473 | 3/1979 | Itoh | 112/158 E |
| 4,227,472 | 10/1980 | Bergvall | 112/158 E |

*Primary Examiner*—Peter P. Nerbun

*Attorney, Agent, or Firm*—Michael J. Striker

[57] ABSTRACT

A sewing machine has a rotatable shaft for operating a stitch forming device, and includes a feed dog for feeding fabric to be sewn, and a needle for forming stitches in the fabric. The machine comprises a first electronic memory for storing stitch control data and including at least the needle position control data for different patterns; pattern selecting element for reading the first memory stitch control data for a selected pattern; timing element operated synchronously with the shaft to produce a timing signal for progressively reading the stitch control data from the first memory; stitch mode changing switch element for determining an elongation rate of a selected pattern to be elongated in a fabric feeding direction; second memory element for temporarily storing designated stitch control data of the first memory element; counter element for counting the ordinals of the stitches of the selected pattern in relation to the timing signals and in accordance with the pattern elongation rate to thereby designate the pattern elongation rate and the stitch control data to be stored into the second memory element progressively during formation of the stitches of the pattern; and calculating element operable with respect to the counter element (CT1, CT2) to make a calculation to produce second stitches between the first stitches formed by the stitch control data.

3 Claims, 5 Drawing Figures

ELECTRONIC SEWING MACHINE

BACKGROUND OF THE INVENTION

1. Field of the Invention

The invention relates to an electronic sewing machine having a memory unit for storing stitch control data for different patterns, which are selectively and progressively read out to control the stitch forming device of the sewing machine to produce a selected pattern of stitches. More particularly the invention relates to an electronic sewing maching having a device including a control circuit which is operated to control the needle positions for the purpose of modifying the stitches of a selected pattern, to thereby elongate the pattern in the fabric feeding direction with a constant feeding pitch and with a predetermined elongation rate.

2. Description of the Prior Art

The conventional pattern elongation device has been used in the sewing machine having a cam-type pattern generating mechanism to elongate a selected pattern in the fabric feeding direction with a constant feeding pitch by way of effectively adjusting transmission relation between the pattern cam and the needle control device. However, such prior art pattern elongation devices are mechanically complicated and are impractical to use. to elongate various patterns and has Heretofore, an electronic sewing machine having an electronic memory for storing stitch control data for controlling the stitch forming device of the sewing machine are generally unknown.

SUMMARY OF THE INVENTION

The present invention has been provided to eliminate the defects and disadvantages of the prior art, by providing an electronic sewing machine having a memory for storing stitch control data which are progressively read out to control the stitch forming device of the sewing machine to form a basic pattern. According to the invention, the number of stitches to be formed between the adjacent stitches of the original pattern are determined by the stitch control data of the adjacent stitches. Then a memorized calculation formula is applied with the stitch control data defining the space between the adjacent stitches, the stitch coordinate changing inclination, and the data representing the number of stitches, and the ordinals thereof to be formed between the adjacent stitches. Thus, new stitch control data are calculated to control the needle of the sewing machine which was originally controlled by the stitch control data stored in the memory. In this way, a selected pattern is elongated in the feeding direction with a predetermined elongation rate and with a constant feeding pitch.

DETAIL DESCRIPTION OF THE INVENTION

Figure 1:
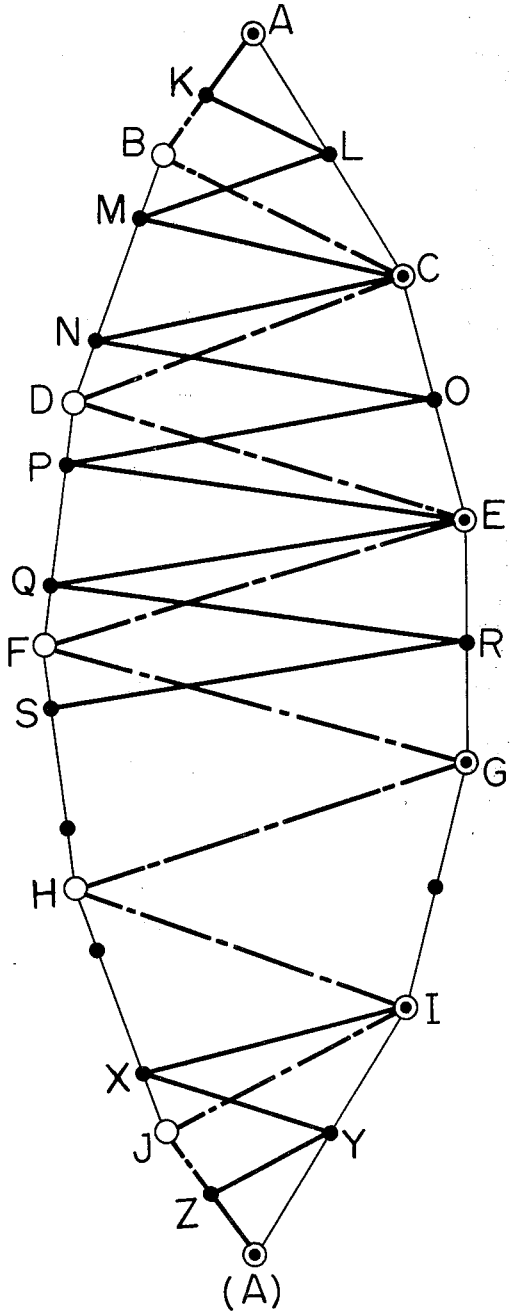
FIG. 1 illustrates a pattern to be elongated by the present invention with a predetermined elongation rate.
Figure 2:
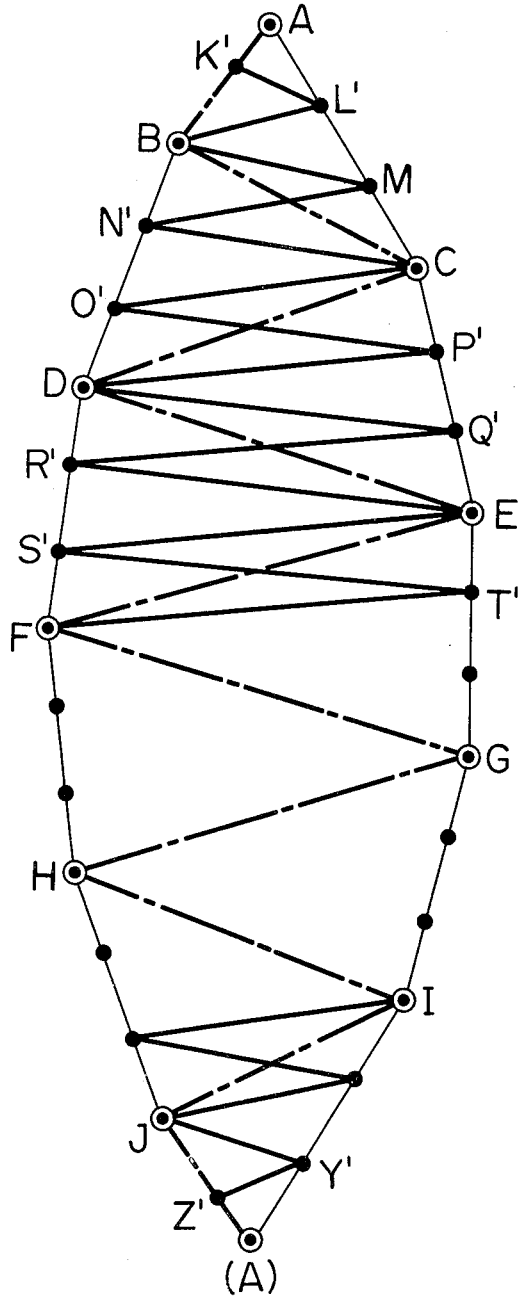
FIG. 2 is the pattern of FIG. 1 to be elongated by the present invention with a different predetermined elongation rate.

In reference to FIGS. 1 and 2, there is shown a pattern produced in accordance with the invention, a series of stitch coordinates A, B, C . . . J are produced by the stitch control data stored in an electronic memory with a constant fabric feeding pitch. In FIG. 1, if the stitch coordinates N, O, P are calculated out, for examples, between the stitch coordinates C and D instead of the stitch coordinate D with the same amount of feeding pitch as with the stitch coordinates A, B, C . . . J, the pattern can be elongated such that it is twice long as the pattern of stitch coordinates A, B, C . . . J. According to the invention, the stitch coordinate N is calculated from the stitch coordinates B and D, the stitch coordinate O is calculated from the stitch coordinates C and E, and the stitch coordinate P is calculated from the stitch coordinates D and F. For example, stitch coordinates C, N, O, P, E are shown with a feeding pitch approximately equal to one half of the feeding pitch of the stitch coordinates A, B, C . . . J. FIG. 2 shows the same pattern of FIG. 1 which is to be elongated as aforesaid, such that it is three times as long as the pattern of stitch coordinates A, B, C . . . J.

Figure 3A:
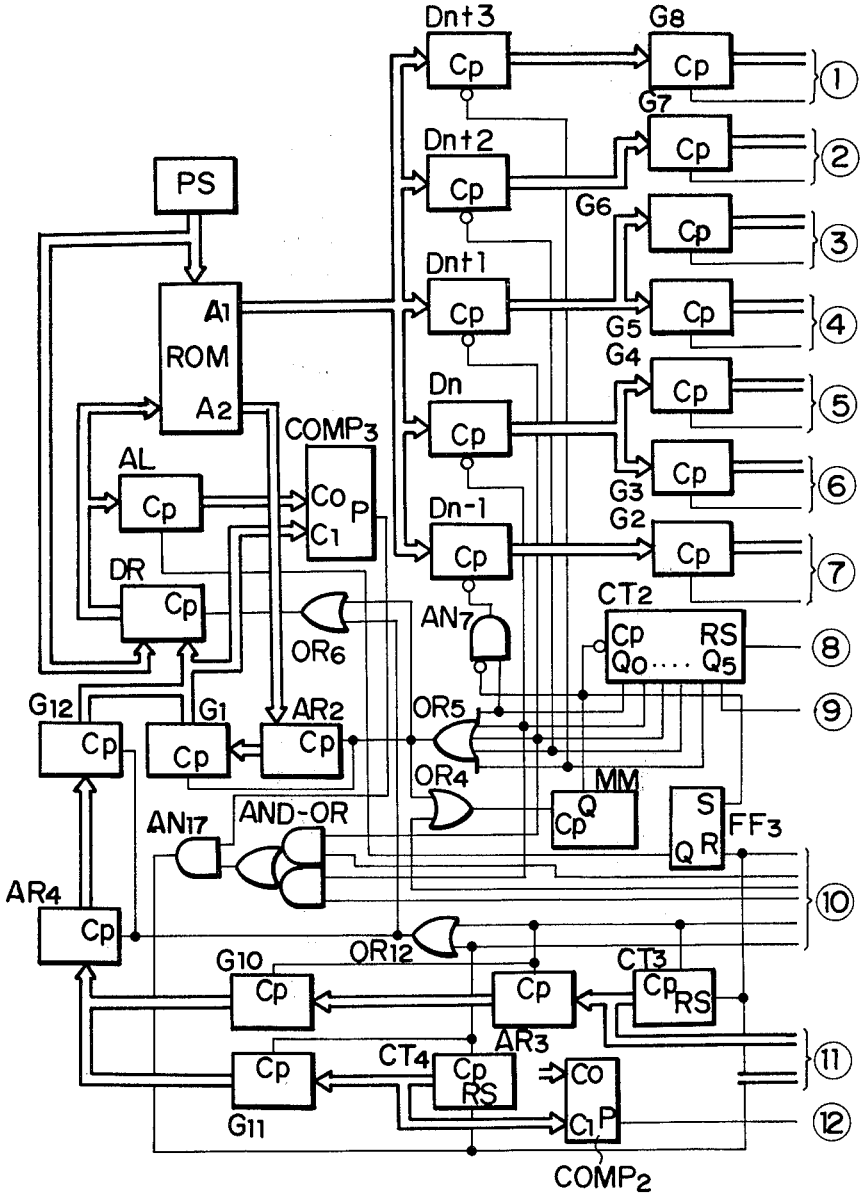
FIGS. 3A and 3B block diagrams which together illustrate a a preferred embodiment of a contral circuit of the present invention.
Figure 3B:
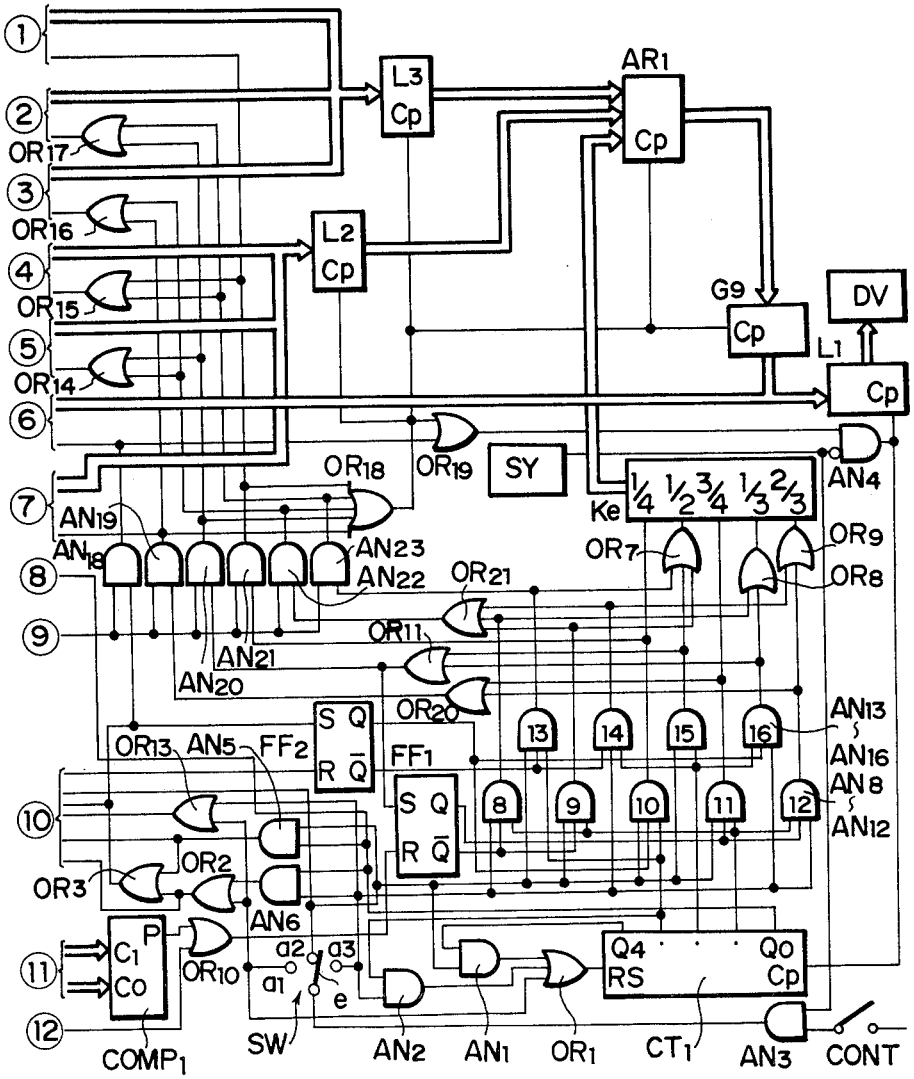

Referring to FIGS. 3A and 3B, ROM is an electronic static memory for storing the stitch control data for controlling a needle of a sewing machine to the stitch coordinates A, B, C . . . J, as is shown in FIGS. 1 and 2. PS is a pattern selecting device including a number of pattern selecting switches selectively operated to a pattern signal for addressing the initial address of the memory ROM. The addresses of the memory ROM are sequentially advanced to read out the stitch control data at the output A1 thereof with a timing pulse generated by a pulse generator SY operated in synchronism with rotation of an upper drive shaft of the sewing machine not herein shown. $CT_1$ is a counter which is reset at the time of application of a control power source or at the time of a pattern selection. If stitch mode changing switch SW is operated to select a pattern elongation, the counter $CT_1$ renders one of the outputs $Q_0$–$Q_4$ high level progressively from the output $Q_0$ a per stitch of a pattern while rendering the others a low level. If the high level goes to a predetermined one of the outputs $Q_0$–$Q_4$, the counter $CT_1$ is reset through an AND circuit $AN_1$ or $AN_2$ and through an OR circuit $OR_1$, and as the result, the initial output $Q_0$ becomes a high level. Thus, the ordinals of stitches are determined.

The stitch mode changing switch SW has a movable contact (e) connected to a timing signal generating device SY through an AND circuit $AND_3$ which is operated to make effective the signal of the timing signal generating device SY when a machine controller switch CONT is closed. The stitch mode changing switch has a fixed contact ($a_1$). If the fixed contact ($a_1$) is in engagement with the movable contact (e), the stitches A–J in FIGS. 1 and 2 are produced in accordance with the stitch control data stored in the memory ROM. Namely, the fixed contact ($a_1$) is connected to the reset terminal RS of the counter $CT_1$ through the OR circuit $OR_1$, and the high level signal at the reset terminal RS resets the counter $CT_1$. The stitch mode changing switch SW has another fixed contact ($a_2$). If the fixed contact ($a_2$) is in engagement with the movable contact (e), the stitches illustrated by a solid line in FIG. 1 are produced. in FIG. 1. Namely, a pattern is produced that is elongated twice as long as the original pattern. The fixed contact ($a_2$) is connected to one input of the AND circuit $AN_1$. The stitch mode changing switch SW has another fixed contact ($a_3$) connected to one input of the AND circuit $AN_2$. As is shown in FIG. 2, If the fixed contact ($a_3$) is in engagement with the movable contact (e), the stitches illustrated by the solid line are produced. Namely, a pattern is produced that is elongated about three times as long as the original pattern.

The AND circuits $AN_1$ and $AN_2$ have the other inputs connected to the output terminals $Q_4$, $Q_3$ of the counter $CT_1$, respectively. Each time the output $Q_4$, or $Q_3$ becomes a high level, the counter $CT_1$ is reset and the output $Q_0$ is rendered a high level. It is therefore possible, as is mentioned hereinafter, to reset the counter $CT_1$ after a desired number of stitches are produced so as to determine the stitches between the basic stitches, for example, between the stitches B and D or D and F shown in FIGS. 1 and 2, to thereby determine the pattern elongation rate of a pattern.

The counter $CT_1$ has a trigger terminal $C_p$ connected to an AND circuit $AN_4$ so that the counter may advance counting at the high level signal of the timing signal generating device SY. The timing signal generating device SY is designed to produce a timing signal which is turned to a high level after a needle of the sewing machine (not shown) comes out of a fabric to be sewn and is turned to a low level just before the needle penetrates the fabric. $CT_2$ is a ring counter which is reset at the time of application of the control power source or at the time of a pattern selection. MM is a monostable multivibrator circuit which is operated by way of an AND circuit $AN_5$ or $AN_6$ and by way of OR circuits $OR_2$, $OR_3$, $OR_4$, when the movable contact (e) of the stitch mode changing switch SW is in engagement with the fixed contact ($a_2$) or ($a_3$) and the output $Q_0$ is a high level and the controller switch CONT is closed. When a low level signal of the monostable multivibrator circuit MM is applied to the trigger terminal of the counter $CT_2$, the counter $CT_2$ turns the output $Q_0$ to a low level from a high level and the output $Q_1$ to a high level, to thereby maintain the operation of the monostable multivibrator circuit MM through the OR circuits $OR_4$, $OR_5$. Subsequently, the counter $CT_2$ turns one of the outputs $Q_2$–$Q_5$ to a high level progressively while turning the others to a low level.

The counter $CT_2$ has a reset terminal RS connected to the output $Q_0$ of the counter $CT_1$, and is reset by the high level signal at the output $Q_0$. When the movable contact (e) of the stitch mode changing stitch SW is in engagement with the fixed contact ($a_1$), the counter $CT_2$ is not operated by way of the AND circuits $AN_5$ and $AN_6$. The function of the counter $CT_2$ is to read out a plurality of stitch control data from the memory ROM for a single stitch and to selectively the read out stitch control data to a stitch forming device DV of the sewing machine, or to read out a plurality of the stitch control data from the memory ROM for a single stitch and give the read out data to a calculating device $AR_1$ which calculates a new stitch control data from the given stitch control data. The memory ROM is addressed to produce a stitch control data $A_1$ at the designated address together with an address signal $A_2$ for designating the next address. Another calculating device $AR_2$ receives the address signal $A_2$ and is operated by a high level signal at any of the outputs $Q_1$–$Q_4$ of the counter $CT_2$, which signal is applied to the trigger terminal $C_p$ of the calculating device $AR_2$ to make a calculation for advancing the address of the memory by one. The output of the calculating device $AR_2$ is applied to a pattern data read-out device DR through a tristate buffer $G_1$, the gate of which is opened by the same high level output signal of the counter $CT_2$.

The pattern data read-out device DR has a trigger terminal $C_p$ receiving, through an OR circuit $OR_6$, a trigger signal at a time a little later than the calculating device $AR_2$ to transmit the output signal of the calculating device $AR_2$ to the memory ROM as an address signal. Dn−1, Dn, Dn+1 Dn+2, Dn+3 are latch circuits, that is to say temporary electronic memories, each have a trigger terminal $C_p$ for receiving a low level signal to latch the stitch control data $A_1$ of the memory ROM. The latch circuit Dn−1 receives the trigger signal through an AND circuit $AN_7$, and latches the stitch control data $A_1$ when the output $Q_0$ of the counter $CT_2$ is changed to a low level from a high level immediately after the monostable multivibrator circuit MM becomes inoperative. The latch circuits Dn−Dn+3 progressively latch the stitch control data $A_1$ which are progressively read out from the memory ROM as the addresses of the memory ROM are progressively advanced by way of the calculating device $AR_2$ while the outputs $Q_1$–$Q_4$ are turned to a low level from a high level.

$G_2$, $G_3$ and $G_4$, $G_5$ and $G_6$, $G_7$, and $G_8$ are tristate buffers receiving the outputs from the latch circuits Dn−1 to Dn+3, respectively, and having trigger terminals $C_p$, respectively, which are turned to a high level to open the gates of the respective buffers. The output of the buffer $G_3$ is connected to a latch circuit $L_1$, the outputs of the buffers $G_2$, $G_4$, $G_5$ are connected to a latch circuit $L_2$, and the outputs of the buffers $G_6$, $G_7$, $G_8$ are connected to a latch circuit $L_3$. The latch circuits $L_2$, $L_3$, upon receiving a trigger signal at the trigger terminal $C_p$ thereof, latch the outputs of the buffers to give the same outputs to the calculating device $AR_1$. The calculating device $AR_1$, upon receiving a high level signal at the trigger terminal thereof, gives the calculated output to the latch circuit $L_1$ through a tristate buffer $G_9$. The latch circuit $L_1$, upon receiving a high level signal at the trigger terminal thereof, gives the stitch forming device the output of the latch circuit Dn or the output of the calculating device $AR_1$.

Ke is constant generating device having the inputs $\frac{1}{4}$, $\frac{1}{2}$, $\frac{3}{4}$, $\frac{1}{3}$, $\frac{2}{3}$, one of which is selectively rendered a high level to give the corresponding constant to the calculating device $AR_1$. The calculating device $AR_1$ makes a calculation Ke $(L_3-L_2)+L_2$ from the outputs of the constant generating device Ke and of the latch circuits $L_2$, $L_3$ to determine the stitch coordinates K–Z shown and K′–Z′ in FIGS. 1 and 2, and gives the output to the latch circuit $L_1$. AND circuits $AN_8$–$AN_{16}$ and OR circuits OR7–OR9 designate one of the inputs of the constant generating device Ke in response to the operation of the counter CT, which depends upon the operation of the stitch mode changing switch SW. Flip-flop circuits $FF_1$, $FF_2$ are so connected so as to produce the initial and the last calculated stitch coordinates K, K′ and Z, Z′ which are specific from the intervening stitches as will be mentioned hereinlater.

$CT_3$ and $CT_4$ are counters which are reset at the time of application of the control power source or at the time of a pattern selection. The output $Q_0$ of the counter $CT_1$ is connected to the trigger terminal $C_p$ of the counter $CT_3$ through the AND circuit $AN_5$, and is also connected to the trigger terminal $C_p$ of the counter $CT_4$ through the AND circuit $AN_6$ and OR circuit $OR_2$, so that each high level signal at the output $Q_0$ may advance the count of the counter $CT_3$ or $CT_4$ while the movable contact (e) of the stitch mode changing switch is in engagement with the fixed contact ($a_2$) or ($a_3$). Comparators $COMP_1$, $COMP_2$ receive the outputs of the counters $CT_3$, $CT_4$, respectively. Each compare the input $C_1$ and the reference input $Co=1$ thereof and discriminate if the input $C_1$ is count 1 or not. If each input $C_1$ is count 1, the counters $CT_3$, $CT_4$ transmit the output P to the reset terminal R of the flip-flop $FF_1$ to reset the flip-flop through an OR circuit $OR_{10}$. Then the output $Q_1$ of the counter $CT_1$ is a high level. This enables the AND circuits $AN_9$, $AN_8$ to calculate out the second stitch coordinate so as to designate the input $\frac{1}{2}$, or $\frac{1}{3}$ of the constant generating device Ke while the fixed contact ($a_2$) or ($a_3$) of the stitch mode changing switch SW is effective. Thus, a constant is produced to determine the stitch coordinate K or K' shown in FIG. 1 or 2. In this connection, when the output $Q_0$ of the counter $CT_1$ is a high level, the output produce one of the stitches A–J in FIGS. 1 and 2, and the constant generating device Ke receives no input, and therefore gives no effective output.

Then the output $Q_2$ of the counter $CT_1$ becomes a high level for producing the third stitch L or L'. On the condition that the fixed contact ($a_2$) or ($a_3$) of the stitch mode changing switch SW is effective and/or that the flip-flop circuit $FF_2$ is set, the flip-flop $FF_1$ is set by way of an AND circuit $AN_{15}$ or $AN_{16}$ and by way of an OR circuit $OR_{11}$, and the true side output Q is connected to one input of AND circuits $AN_{11}$, $AN_{12}$ to designate the constant $\frac{3}{4}$ or $\frac{2}{3}$ of the constant generating device Ke each time the output $Q_1$ of the counter $CT_1$ becomes a high level and in accordance to the selection of the fixed contact ($a_2$) or ($a_3$) of the stitch mode changing switch SW. The flip-flop circuit $FF_2$ receives at the set terminal thereof a high level signal of the output $Q_0$ of the counter $CT_1$ through the AND circuit $AN_5$ or $AN_6$ and through the OR circuits $OR_2$, $OR_3$. The flip-flop $FF_2$ has a true side output Q connected to AND circuits $AN_{15}$, $AN_{16}$, and causes the AND circuit $AN_{16}$ to produce the output each time the output $Q_2$ of the counter $CT_1$ becomes a high level. Similarly, the flip-flop $FF_2$ designates the constant $\frac{1}{4}$ of the constant generating device Ke through the AND circuit $AN_{10}$ each time the output $Q_3$ of the counter $CT_1$ becomes a high level while the fixed contact ($a_2$) of the stitch mode changing switch SW is selected.

The flip-flop circuit $FF_2$ has a reset terminal R for receiving the output of an AND circuit $AN_{17}$, so that the flip-flop may be reset just before the final calculated stitch Z or Z' in FIG. 1 or 2 is formed. The flip-flop $FF_2$ has a complement side output Q connected to the input side of AND circuits $AN_{13}$, $AN_{14}$ so as to designate the constant $\frac{1}{2}$ of the constant generating device Ke through AND circuit $AN_{13}$ and OR circuit $OR_7$ when the output $Q_3$ of the counter $CT_1$ becomes a high level while the fixed contact ($a_2$) of the stitch mode changing switch SW is selected. Thus, the stitch coordinate Z in FIG. 1 is calculated out. Similarly, when the fixed contact ($a_3$) of the stitch mode changing switch SW is selected, the flip-flop circuit $FF_2$ designates the constant $\frac{2}{3}$ through the AND circuit $AN_{14}$ and OR circuit $OR_9$ to calculate out the stitch coordinate Z' when the output $Q_2$ of the counter $CT_1$ becomes high level. On the other hand, when the fixed contact ($a_1$) of the stitch mode changing switch SW is selected, the counter $CT_4$ advances the count independently of the counter $CT_1$ through the OR circuit $OR_2$ each time the timing signal generating device SY produces a high level signal.

$AR_3$ is a calculating device for receiving the output of the counter $CT_3$ having a trigger terminal $C_p$ for receiving a trigger signal together with output of the counter $CT_3$. The calculating device $AR_3$ seeks a value (n) as an address relation signal for the memory ROM from the formula $n=2m-1$, provided the value counted with the trigger signal is (m), and gives the calculated output to another calculating device $AR_4$ through a tristate buffer $G_{10}$. The calculating device $AR_4$ receives the output of the counter $CT_4$ through a tristate buffer $G_{11}$, and receives the value as an address relation signal (n) for the memory ROM which is counted by the counter $CT_4$ with the trigger signal. The calculating device $AR_4$ has a trigger terminal $C_p$ for receiving a trigger signal through OR circuit $OR_{12}$ the trigger signal together with the buffers $G_{10}$, $G_{11}$ to selectively provide a outputs of the buffers $G_{10}$, $G_{11}$ are selectively received, so as a to provide a value (i) as an address signal for the memory ROM from the formula $i=n-1$, which value is applied to the pattern data read-out device DR through a tristate buffer $G_{12}$, the gate of which is simultaneously opened.

The pattern data read-out device DR selectively receives the outputs of the calculating devices $AR_2$, $AR_4$ as an address signal for the memory ROM in response to the trigger signal passing through the OR circuit $OR_5$ or $OR_{12}$. The device DR receives the signal of the pattern selecting device PS to designate the initial address of the memory ROM after it designates the last address of a pattern. The calculating device $AR_2$ receives the address signal (i) from the output $A_2$ of the memory ROM to make a calculation $i=i+1$. The memory ROM stores a data for the stitch coordinate J at the address 0 thereof for a selected pattern, for example, as shown is in FIGS. 1 and 2, and stores the data for the following stitch coordinates A, B, C . . . at the addresses 1, 2, 3 . . . . An initial address storing memory AL stores the address 0 when the memory AL receives a high level signal at the trigger terminal $C_p$ thereof. Namely, when the output $Q_0$ of the counter $CT_1$ becomes a high level at the time of a pattern selection of a pattern, as is shown in FIGS. 1 and 2, the counter $CT_3$ or $CT_4$ counts 1 and makes 0 the address of the memory ROM and the input (i) of the memory AL. Simultaneously, the memory AL stores the signal $i=0$ with a high level signal at the true side output Q of the flip-flop $FF_3$ applied to the trigger terminal $C_p$ of the memory AL, said flip-flop $FF_3$ being set by a high level signal of the monostable multivibrator circuit MM which is operated by way of the OR circuits $OR_3$, $OR_4$.

Comparator $COMP_3$ has an input connected to the output of the buffer $G_1$ or $G_{12}$, and compares the output with a reference signal Co, i.e. 0 of the memory AL to produce the output signal at the output P thereof when the output of the buffer $G_1$ or G12 comes in accord with the reference signal 0. The output signal of the comparator $COMP_3$ is high level and is given to an AND circuit $AN_{17}$ which receives the outputs $Q_2$, $Q_1$ of the counter $CT_2$ through AND-OR circuit. The AND-OR circuit has its inputs connected to the fixed contact ($a_2$), and to the fixed contacts ($a_1$), ($a_3$) of the stitch mode changing switch SW through OR circuit $OR_{13}$, and becomes a high level with a high level signal of the output $Q_2$ or $Q_1$ of the counter $CT_2$, to thereby reset the counters $CT_3$, $CT_4$ and the flip-flop circuits $FF_2$, $FF_3$ when one of the fixed contacts ($a_1$), ($a_2$), ($a_3$) is selected.

Namely, while the counter $CT_2$ is operated to advance the addresses of the memory ROM to read out a set of stitch control data prior to formation of a stitch as aforementioned, the reset condition of the counters $CT_3$, $CT_4$ and the flip-flop circuits $FF_2$, $FF_3$ designates the address 0 of the memory ROM, to thereby terminate the read-out of the final stitch control data of a pattern when the output $Q_5$ of the counter $CT_2$ becomes high level and simultaneously to return the control circuit to the initial condition, so as to repeatedly produce the stitches of the selected pattern.

AND circuits $AN_{18}$–$AN_{23}$, each of which has one input connected to the output $Q_5$ of the counter $CT_2$, determine the opening time of the buffers $G_2$–$G_9$, the latching time of the latch circuits $L_1$, $L_2$, $L_3$ and the output time of the calculating device $AR_1$ through the OR circuits $OR_{14}$–$OR_{19}$ and the AND circuit $AN_4$ or directly. The AND circuit $AN_{18}$ has another input connected to the output of the OR circuit $OR_3$ to open the buffer $G_3$ when the output of the OR circuit is high level, and simultaneously to latch the data of the latch circuit Dn to the latch circuit $L_1$ through the OR circuit $OR_{19}$ and the AND circuit $AN_4$ and with the timing signal of the timing signal generating device SY, to thereby give the stitch forming device DV the initial data of the pattern. The AND circuit $AN_{19}$ has another input connected to the outputs of the AND circuits $AN_{11}$, $AN_{12}$ through the OR circuit $OR_{20}$ to latch the data of the latch circuit Dn−1 to latch $L_2$ and the data of the latch circuit Dn+1 to the latch circuit $L_3$, so that the calculating device $AR_1$ may make a calculation $Ke\cdot(L_3-L_2)+L_1$ with the data and the constant $\frac{3}{4}$ or $\frac{2}{3}$ of the constant generating device Ke at that time. Then the calculated effect is given to the stitch forming device DV through the latch circuit $L_1$ with the low level signal of the timing signal generating device SY.

The AND circuit $AN_{20}$ has another input connected to the outputs of the AND circuits $AN_{15}$, $AN_{16}$ through the OR circuit $OR_{11}$ to latch the data of the latch circuit Dn to the latch circuit $L_2$ and the data of the latch circuit $L_3$, so that the calculating device $AR_1$ may make the same calculation with the data and the constant $\frac{1}{2}$ or $\frac{1}{3}$ of the constant generating device Ke. The AND circuit $AN_{21}$ has another input connected to the output of the AND circuit $AN_{10}$ to latch the data of the latch circuit Dn+1 to the latch circuit $L_2$ and the data of the latch circuit Dn+3 to the latch circuit $L_3$, so that the calculating device $AR_1$ may make the same calculation with the data and the constant $\frac{1}{4}$ of the constant generating device Ke. The AND circuit $AN_{22}$ has another input connected to the outputs of the AND circuits $AN_8$, $AN_9$, $AN_{14}$, through the OR circuit $OR_{21}$, to latch the data of the latch circuit Dn to the latch circuit $L_2$ and the data of the latch circuit Dn+1 to the latch circuit $L_3$, so that the calculating device $AR_1$ may make the same calculation with the data and the constant $\frac{1}{3}$ or $\frac{1}{2}$ of the constant generating device Ke. The AND circuit $AN_{23}$ has another input connected to the output of the AND circuit $AN_{13}$ to latch the data of the latch circuit Dn+1 to the latch circuit $L_2$ and the data of the latch circuit Dn+2 to the latch circuit $L_3$, so that the calculating device $AR_1$ may make the same calculation with the data and the constant $\frac{1}{2}$ of the constant generating device Ke.

Figure 4:
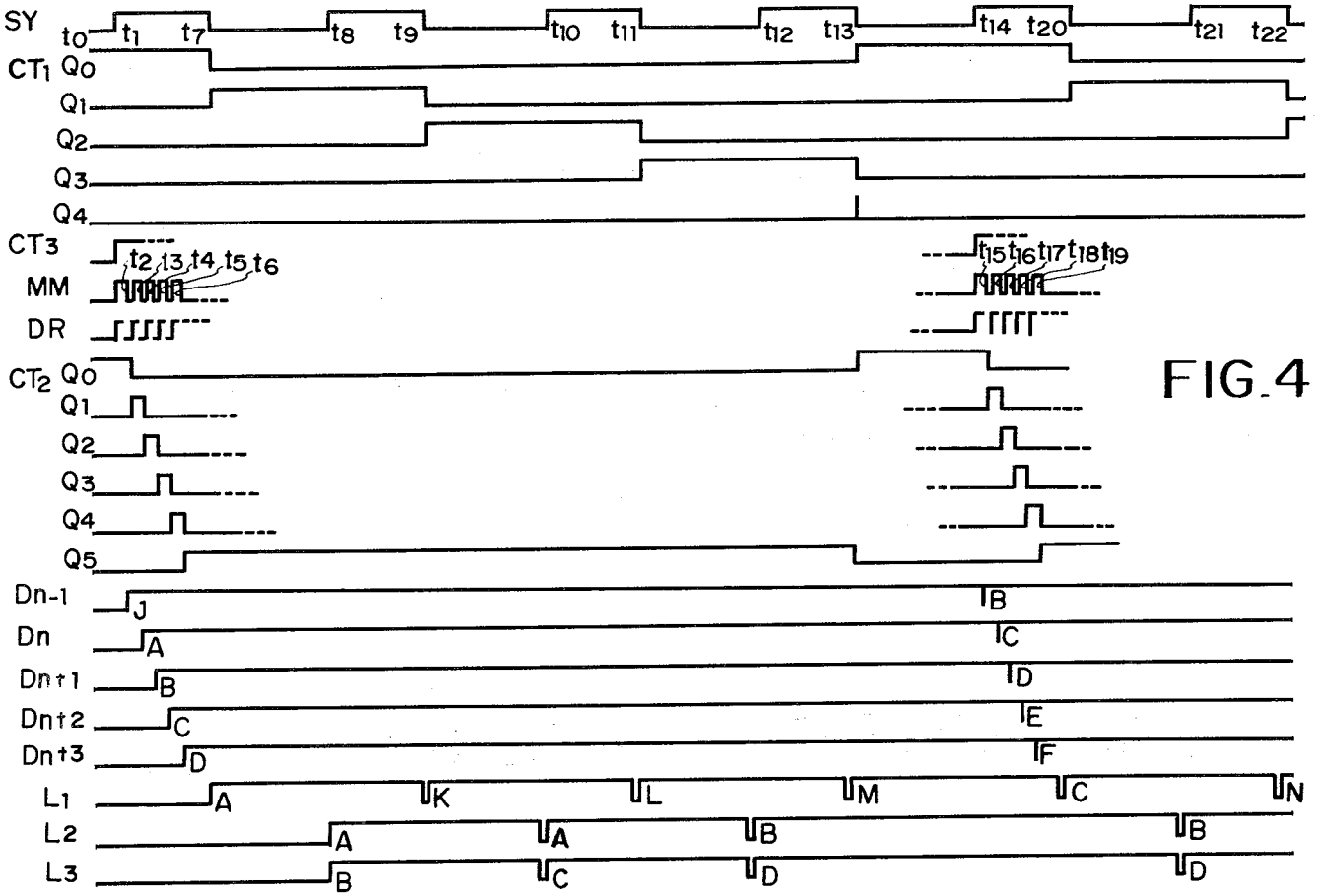
FIG. 4 is a time chart showing the operation times of the circuit components with the output and triggering signal lenses thereof.

Referring now to FIG. 3, and FIG. 4 which shows the operation times of the circuit components with the output and triggering levels thereof for forming the stitches K–Z illustrated by the solid line in FIG. 1, the operation of the aforedescribed control circuit will be described.

If the control power source is applied at time ($t_0$) the counters $CT_1$–$CT_4$, and the flip-flop circuits $FF_1$–$FF_3$ are reset. The pattern selecting device PS is operated to select the original pattern of stitches A–J as shown in FIG. 1 or 2. The stitch mode changing switch SW is operated to close the fixed contact ($a_2$) to select the pattern of stitches K–Z, as shown in FIG. 1. The machine controller switch CONT is closed at time ($t_1$) to drive the sewing machine with a constant speed.

At the time ($t_1$), the counter $CT_3$ receives a high level signal through the AND circuit $AN_5$ and counts up 1 (which is to be represented by a letter m). The flip-flop circuit $FF_1$ receives a new reset signal through the comparator $COMP_1$ and the OR circuit $OR_{10}$. The calculating device $AR_3$ produces an output n=1 from the calculation n=2m−1. The calculating device $AR_4$ produces an output i=0 from the calculation i=n−1. The data read-out device DR gives the address i=0 to the memory ROM and to the initial address storing memory AL. The memory ROM produces the stitch control data $A_1$ in response to the address 0 determining the stitch coordinate J in FIG. 1, and produces the address signal $A_2$, i.e. i=0 to the calculating device $AR_2$.

On the other hand, the flip-flop circuit $FF_2$ is set through the OR circuit $OR_3$ at the time ($t_1$), and at the same time, the monostable multivibrator circuit MM is operated through OR circuit $OR_4$, and the flip-flop $FF_3$ is set. With the high level signal of the flip-flop circuit $FF_3$, the memory AL gives the data O to the reference data input terminal Co of the comparator $COMP_3$.

With the low level signal of the monostable multivibrator circuit MM at time ($t_2$), the latch circuit Dn−1 is triggered through the AND circuit $AN_7$ and latches the stitch control data J ($A_1$). A little later than the time ($t_2$), when the output $Q_0$ of the counter $CT_2$ is turned to a low level and the output $Q_1$ is turned to a high level, the calculating device $AR_2$ receives a trigger signal through the OR circuit $OR_5$ and makes a calculation i→i+1 and gives i=1 to the data read-out device DR and to the input terminal $C_1$ of the comparator $COMP_3$. At the same time, the data read-out device DR receives a trigger signal through the OR circuit $OR_6$ and makes 1 the address (i) of the memory ROM. Then the memory ROM produces the stitch control data $A_1$ for determining the stitch coordinate A in FIG. 1 and sends the address signal i=1 ($A_2$) to the calculating device $AR_2$.

At the time ($t_2$), the output signal of the OR circuit $OR_5$ operates the monostable multivibrator circuit MM through the OR circuit $OR_4$. At the time ($t_3$), when the output $Q_1$ of the counter $CT_2$ is turned to a low level due to the low level signal of the monostable multivibrator circuit MM, the latch circuit Dn latches the stitch control data A ($A_1$). In the same manner, at the times ($t_4$), ($t_5$), ($t_6$), the latch circuits Dn+1, Dn+2, Dn+3 latch the stitch control data B, C, D ($A_1$), respectively, with the outputs $Q_2$, $Q_3$, $Q_4$ of the counter $CT_2$ turned to a low level. When the output $Q_5$ of the counter $CT_2$ becomes a high level, the tristate buffer $G_3$ is opened by way of the AND circuit $AN_{18}$ to transmit the stitch control data A ($A_1$) of the latch circuit Dn to the latch circuit $L_1$.

Since the output of the AND circuit $AN_{18}$ turns one input of the AND circuit $AN_4$ to a high level, the latch circuit $L_1$ latches the stich control data A ($A_1$) with the low level signal of the timing signal generating device SY, to thereby enable the stitch forming device DV to form the initial stitch A in FIG. 1. Simultaneously, the output $Q_0$ of the counter $CT_1$ is turned to a low level and the output $Q_1$ is turned to a high level with the high level signal of the AND circuit $AN_4$. Actually, the operations of the counter $CT_2$ at the times ($t_2$)-($t_6$) advance with a speed high enough to be stopped before the time ($t_7$).

When the output of the timing signal generating device SY becomes a high level at the time ($t_8$), the output $Q_1$ of the counter $CT_1$ opens the gates of the buffers $G_4$, $G_6$ through the AND circuit $AN_9$, OR circuit $OR_{21}$, AND circuit $AN_{22}$ and through the OR circuit $OR_{14}$ and OR circuit $OR_{16}$, to thereby give the stitch control data A and B ($A_1$) of the latch circuits Dn and Dn+1 to the latch circuits $L_2$, $L_3$ respectively, which latch these data with a trigger signal applied thereto through the OR circuit $OR_{18}$ to give the same data to the calculating device $AR_1$. Simultaneously, the output of the AND circuit AN9 designates the constant $\frac{1}{2}$ of the constant generating device Ke through the OR circuit OR7 to give the out-put to the calculating device AR1. Then the calculating device AR1 makes a calculation $Ke\cdot(L3-L2)+L2=\frac{1}{2}(B-A)+A$ for the next stitch K, and gives the calculated effect results to the latch circuit L1. At the time ($t_9$) with the low level signal of the timing signal generating device SY, the latch circuit L1 latches the stitch control data K and causes the stitch forming device DV to form the second stitch K in FIG. 1. Simultaneously, the output Q2 of the counter CT1 becomes a high level. The initial stitch A is formed at the center of the maximum needle swinging range, i.e., at the needle position of swinging amplitude 0. The second stitch K is formed at the needle position between the basic stitch A and the next basic stitch B with a half of the needle swinging amplitude between the stitches A and B, in accordance with the calculation of the calculating device AR1.

In the same manner, at the time ($t_{10}$), the output Q2 of the counter CT1 sets the flip-flop circuit FF1 through the AND circuit AN15 and OR circuit OR11 and opens the gates of the buffers G4, G7 through the AND circuit AN20 and OR circuits OR14, OR17, to give the stitch control data A and C (A1) of the latch circuits Dn, Dn+1 to the latch circuits L2, L3, respectively. Then the latch circuits L2, L3 latch the same data, respectively, so as to give the same to the calculating device AR1. Simultaneously, the output of AND circuit AN15 designates the constant $\frac{1}{2}$ of the constant generating device Ke through the OR circuit OR7 to give the constant to the calculating device AR1. The calculating device AR1 makes a calculation $Ke\cdot(L3-L2)+L2=\frac{1}{2}(C-A)+A$ for the next stitch L and gives the calculated result to the latch circuit L1. At the time ($t_{11}$), the latch circuit L1 latches the stitch control data L to cause the stitch forming device DV to form the third stitch L. Simultaneously, the output Q3 of the counter CT1 is turned to a high level.

At the time ($t_{12}$), the output Q3 of the counter CT1 designates the constant $\frac{1}{4}$ of the constant generating device Ke through the AND circuit AN10, opens the gate of buffer G5 through the AND circuit AN21 and OR circuit OR15 and opens the gate of buffer G8 through the AND circuit AN21, so as to give the data B and D of the latch circuits Dn+1, Dn+3 of the latch circuits L2, L3 respectively. The latch circuits L2, L3, latch the same data, respectively, so as to give the same to the calculating device AR1. The calculating device AR1 makes a calculation $Ke\cdot(L3-L2)+L2=\frac{1}{4}(D-B)+B$ for the next stitch M and gives the calculated effect to the latch circuit L1. At the time ($t_{13}$), the latch circuit L1 latches the data M to cause the stitch forming device DV to form the fourth stitch M. Simultaneously, the output Q4 of the counter CT1 is turned to a high level and is reset by way of the AND circuit AN1 and OR circuit OR1. As a result, the output Q0 of the counter CT1 is turned to a high level, and then the output Q0 of the counter CT2 becomes high level.

As is seen, the calculating device AR1 employs the constant $\frac{1}{2}$ for making a calculation to produce the stitches K and Z while employing the constants $\frac{1}{4}$, $\frac{3}{4}$, i.e., 4-divided constants for making the calculations to produce the stitch M and the following stitches on the left side of the pattern. Namely, in FIG. 1, the stitches A and B for calculating the stitch K are formed with a fabric feeding pitch which is a half of that between the stitches B and D, D and F, . . . . On the other hand, the calculating device AR1 employs the constants $\frac{1}{2}$ for making a calculation to produce the stitches L, O, R . . . on the right side of the pattern. This is because the needle is initially deflected to the left from the stitch A. These stitches L, O, R, . . . formed when the needle is deflected to the right from the stitches K, N, Q . . . respectively are positioned opposite to the basic stitches B, D, F, . . . .

At the time ($t_{14}$) when the signal of the timing signal generating device SY becomes a high level, the counter CT3 is operated to count up to make m=2. Then the calculating device AR3 makes a calculation n=2m−1=3 and the calculation i=n−1=2 to designate the address 2 of the memory ROM. In the same manner, the address of the memory ROM is advanced to 3, 4, . . . from the address 2 in accordance with the count-up of the counter CT2, and the latch circuits Dn−1, Dn . . . , Dn+3 latch the data B, C, . . . F, respectively. At the time ($t_{20}$), the latch circuit L1 latches the data C to cause the stitch forming device DV to form the fifth stitch C.

At the time ($t_{21}$), the output Q1 of the counter CT1 designates the constant $\frac{3}{4}$ of the constant generating device Ke through the AND circuit AN11 and opens the gate of buffer G2 through the OR circuit OR20 and AND circuit AN19, and also opens the gate of buffer G6 through the OR circuit OR16 to give the data B, D of the latch circuits Dn−1, Dn+1 to the latch circuits L2, L3, respectively. These latches L2, L3 latch the same data to give the same to the calculating device AR1. The calculating device AR1 makes a calculation $Ke\cdot(L3-L2)+L2=\frac{3}{4}(D-B)+B$ and gives the calculated effect to the latch circuit L1. At the time ($t_{22}$), the latch circuit L1 latches the data N to cause the stitch the data N to cause the stitch forming device DV to form the sixth stitch N.

In the same manner, the following stitches are formed one after another. When the sixteenth stitch H is formed, and the output Q0 of the counter CT1 is turned to a high level, the counter CT3 is operated to count to make m=5. The calculating device AR3 makes a calculation n=2m−1=9, and the calculating device AR4 makes a calculation i=n−1=8 to designate the address 8 of the memory ROM. As the counter CT2 counts, the address of the memory ROM is advanced to 9, 10 . . . from the address 8, and the latch circuits Dn−1, Dn . . . Dn+3 latch the data H, I, J, A, B respectively. In this process, when the output Q2 of the counter CT2 is turned to a high level, the calculating device AR2 is i=0, and therefore the output P of the comparator COMP3 is a high level and the AND circuit AN17 is a high level due to the input thereof from the AND-OR circuit, to thereby reset the counters CT3, CT4 and the flip-flops FF2, FF3. With the following low level signal of the timing signal generating device SY, the seventeenth stitch I is formed and the output Q1 of the counter CT1 is turned to a high level.

The eighteenth stitch X is formed with the calculation by way of the AND circuit AN11 and with the following low level signal of the timing signal generating device SY, and then the output Q2 of the counter CT1 is turned to a high level.

The nineteenth stitch Y is formed with the calculation by way of the AND circuit AN15 and with the following low level signal of the timing signal generating device SY, and then the output Q3 of the counter CT1 is turned to a high level.

The twentieth stitch Z is formed with the calculation by way of the AND circuit AN13 and with the following low level signal of the timing signal generating device SY, and then the output Q4 of the counter CT1 is turned to a high level. Then the counter CT1 is immediately reset and the output Q0 is turned to a high level. With the following high level signal of the timing signal generating device SY, the count-up of the CT3 returns to the time ($t_1$), and the pattern is repeatedly produced.

Now if the fixed contact (a3) of the stitch mode changing switch SW is closed to select the pattern of stitches A, K', L', B, M' . . . Z', illustrated by a solid line in FIG. 2, the counter CT4 and the comparator COMP3 are operated, instead of the counter CT3. The counter CT4 is operated to count each time the output Q0 of the counter CT1 becomes a high level and gives the value (n) to the calculating device AR4, so that the calculating device AR4 may make a calculation i=n−1. The counter CT1 is reset when the output Q3 is turned to a high level, and the output of the counter is transmitted to the calculating device AR1 through the AND circuit AN8, AN12, AN14, AN16, so that a series of data controls may be implemented as was implemented in the production of the pattern stitches of FIG. 1.

On the other hand, if the fixed contact (a1) of the stitch mode changing switch SW is closed to select the original pattern of stitches A–J shown in FIG. 1 or 2, the counter CT4 counts up n=1 at the time $t_1$, and the latch circuits Dn−1 to Dn+3 latch the data J, A, . . . D, respectively. The initial stitch A is formed at the time ($t_7$), and then the output Q1 of the counter CT1 becomes high level. The counter CT1 is reset at the time ($t_8$) through the OR circuit OR1. Therefore, the other outputs of the counter CT1 will not be turned to a high level, and the AND circuits AN8, AN9, AN11, AN12 receiving the output Q1 of the counter CT1 will not be turned to a high level because these AND circuits are connected to the fixed contact (a2) or (a3) and not to the contact (a1) of the stitch mode changing switch SW. Therefore, the AND circuits AN10 to AN23 will not be turned to a high level, and only the data of the latch circuit Dn is latched to the latch circuit L1. The data of the other latch circuits Dn−1, Dn+2, Dn+3 are not used. The counter CT2 is reset with a high level output Q0 of the counter CT1 at the time ($t_8$), and the data of the latch circuits Dn−1 to Dn+3 are changed immediately after the time ($t_{14}$). Namely, at the time ($t_8$), the counter CT4 counts up n=2 to designate the address 1 of the memory ROM to read the data A. With the subsequent operations of the counter CT2, the latch circuits Dn−1 to Dn+3 latch the data A to E, respectively, and the data B of the latch circuit Dn is latched to the latch circuit L1 and the second stitch B is formed.

In the same manner, the stitches C, D, . . . I are formed one after another, and the counter CT4 counts up n=10 with the subsequent high level signal of the timing signal generating device SY and the address 9 of the memory ROM is designated. Then the latch circuits Dn−1, Dn . . . Dn+3 latch the data I, J, A, B, C, respectively. In this process, the counter CT4 is reset with the output of the comparator COMP3. With the subsequent low level signal of the timing signal generating device SY, the tenth stitch J is formed. With the next high level signal of the timing signal generating device SY, the counter counts up n=1. Thus, the control circuit is returned to the initial condition for repeatedly forming the pattern.

While the invention has been illustrated and described as embodied in an electronic sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claim as new and desired to be protected by Letters Patent is set forth in the appended claims:

1. A sewing machine having a rotatable shaft means for operating a stitch forming device and including feed dog means for feeding a fabric to be sewn and a needle for forming stitches in the fabric, the machine comprising:

(a) first electronic memory means (ROM) for storing stitch control data, said first memory means including at least the needle position control data for different positions;

(b) pattern selecting means for reading out from said first memory said stitch control data for a selected pattern;

(c) timing means (SY) operated synchronously with said shaft means to produce a timing signal for progressively reading out said stitch control data from said first memory;

(d) stitch mode changing switch means (SW) selectively operated to determine an elongation rate of a selected pattern to be elongated in a feeding direction;

(e) second memory means (Dn−1 to Dn+3) for temporarily storing designated stitch control data of said first memory means;

(f) counter means (CT1, CT2) for counting the ordinals of stitches of a selected pattern in relation to a timing signal of the timing means and in accordance with said pattern elongation rate determined by the stitch mode changing means, to thereby designate the pattern elongation rate and the stitch control data to be stored in said second memory means progressively during formation of the stitches of said pattern; and (g) calculating means (AR1,Ke) operable with respect to an output of said counter means to make a calculation to produce different stitches between the stitches which are formed by the stitch control data stored in the second memory means.

2. The sewing machine as recited in claim 1 wherein said pattern selecting means includes pattern selecting switches, said switches being operable to read out from said first memory means.

3. The sewing machine as recited in claim 1, wherein said calculating means includes a predetermined number of constants, said calculating means being operated with respect to a counted output of said counter means so as to make said calculation by selectively using said constants and said needle position control data of said stitch control data stored in said second memory.

* * * * *